United States Patent [19]

Nelson

[11] Patent Number: 4,502,944

[45] Date of Patent: Mar. 5, 1985

[54] FRACTIONATION OF HEAVY HYDROCARBON PROCESS MATERIAL

[75] Inventor: Stephen R. Nelson, Edmond, Okla.

[73] Assignee: Kerr-McGee Refining Corporation, Oklahoma City, Okla.

[21] Appl. No.: 424,290

[22] Filed: Sep. 27, 1982

[51] Int. Cl.[3] ..... C10C 1/18; C10C 3/08

[52] U.S. Cl. ..... 208/45; 208/309

[58] Field of Search ..... 208/45, 309

[56] References Cited

U.S. PATENT DOCUMENTS

| | | | |
|---|---|---|---|
| 2,131,205 | 9/1938 | Wells et al. | 208/41 |
| 2,255,283 | 9/1941 | Forrest | 208/39 |
| 2,305,440 | 12/1942 | Noel | 208/22 |
| 2,527,404 | 10/1950 | De Vault | 208/309 |
| 2,603,587 | 7/1952 | Simms | 208/309 |
| 2,664,384 | 12/1953 | Benedict | 208/309 |
| 2,940,920 | 6/1960 | Garwin | 208/45 |
| 3,005,709 | 10/1961 | Garvin | 208/309 |
| 3,088,907 | 5/1963 | Eldib et al. | 208/39 |
| 3,159,571 | 12/1964 | Reman et al. | 208/39 |
| 3,202,605 | 8/1965 | Redcay | 208/309 |
| 3,278,415 | 10/1966 | Doberenz et al. | 208/45 |
| 3,364,138 | 1/1968 | Campagne et al. | 208/45 |
| 3,507,777 | 4/1970 | Hemminger | 208/309 |
| 3,607,717 | 9/1971 | Roach | 208/8 |
| 3,919,072 | 11/1975 | Pitchford et al. | 208/39 |
| 3,969,196 | 7/1976 | Zosel | 203/49 |
| 4,101,415 | 7/1978 | Crowley | 208/309 |
| 4,201,660 | 5/1980 | Zosel | 208/309 |
| 4,239,616 | 12/1980 | Gearhart | 208/309 |
| 4,240,898 | 12/1980 | Gomi | 208/40 |
| 4,273,644 | 6/1981 | Harris et al. | 208/45 |
| 4,290,880 | 9/1981 | Leonard | 208/309 |
| 4,305,814 | 12/1981 | Leonard | 208/309 |

FOREIGN PATENT DOCUMENTS

| | | | |
|---|---|---|---|
| 1623803 | 7/1961 | Canada | 208/309 |

OTHER PUBLICATIONS

Petroleum "Compressed Hydrocarbon Gases as a Solvent", 8-60, T. P. Zhuze.

Zosel, "Separation with Supercritical Gases: Practical Applications", Angew. Chem. Int. Ed. Engl., 17, 702-709, (1978).

*Primary Examiner*—Delbert E. Gantz

*Assistant Examiner*—Helane Myers

*Attorney, Agent, or Firm*—William G. Addison

[57] ABSTRACT

A method of separating a process material comprising oils, resins and asphaltenes into at least three fractions. The process material is mixed in a mixing zone with a solvent selected from the group consisting of paraffinic hydrocarbons having between about 3 and about 8 carbon atoms. The process material-solvent mixture is introduced into a first separation zone to form an asphaltene-rich first heavy fraction and a resin-rich intermediate fraction, separated by a first liquid-liquid interface, and to form a first light fraction, rich in solvent and oils, separated from the intermediate fraction by a second liquid-liquid interface.

The first heavy fraction and the intermediate fraction are withdrawn from the first separation zone. The first light fraction is introduced into a second separation zone to separate a second heavy fraction, rich in oils, and a second light fraction, rich in solvent.

4 Claims, 1 Drawing Figure

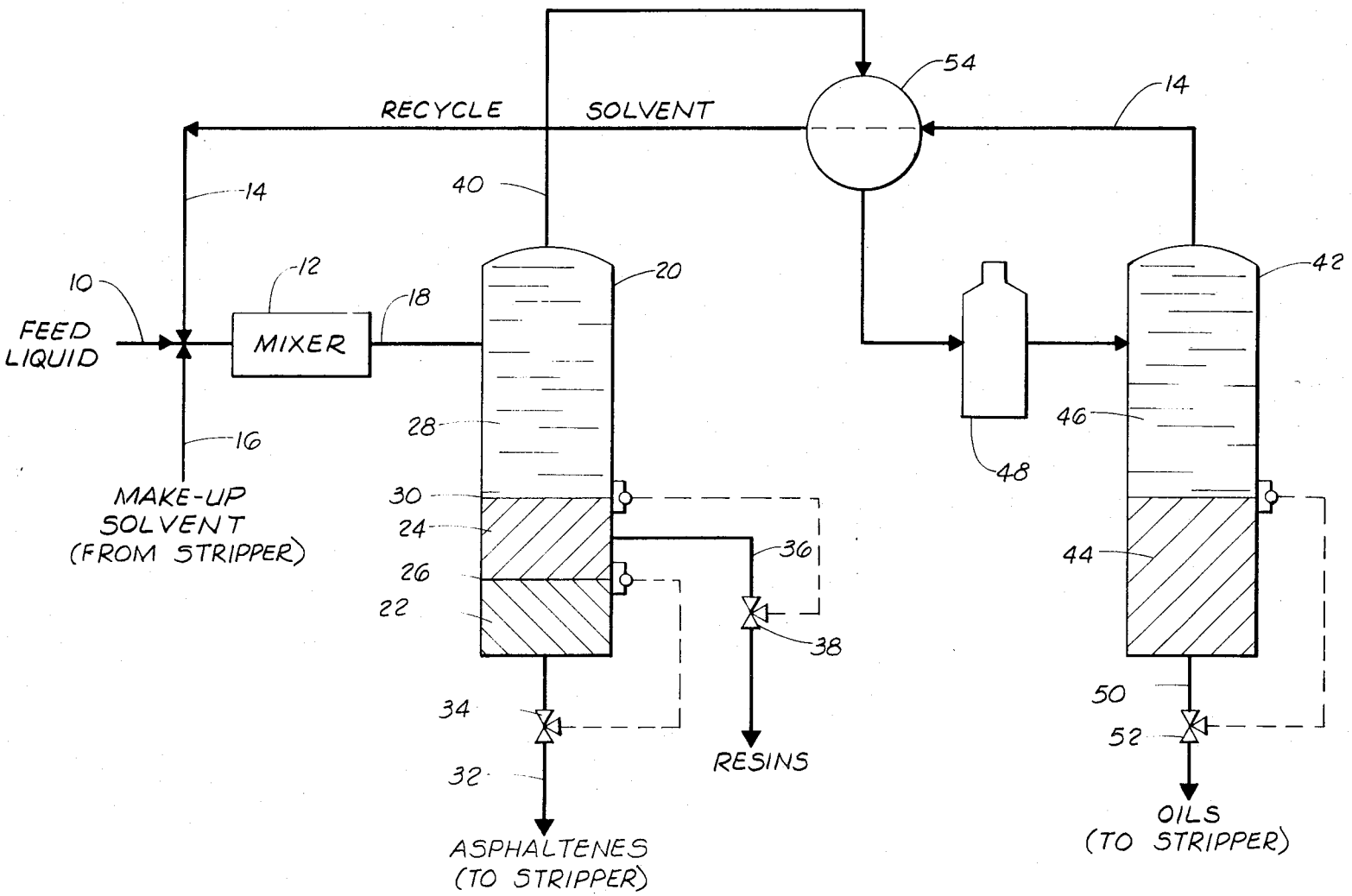
FEED LIQUID
10
MAKE-UP SOLVENT (FROM STRIPPER)
16
14
MIXER
12
18
RECYCLE
SOLVENT
40
20
28
30
24
26
22
34
32
ASPHALTENES (TO STRIPPER)
36
38
RESINS
54
48
46
44
42
50
52
OILS (TO STRIPPER)
14

FRACTIONATION OF HEAVY HYDROCARBON PROCESS MATERIAL

FIELD OF THE INVENTION

The present invention relates to a method of separating a heavy hydrocarbon process material comprising asphaltenes, resins and oils into at least three fractions, and more particularly to such a method employing light organic solvents under elevated temperature and pressure conditions.

SUMMARY OF THE INVENTION

The present invention comprises a method of separating a process material comprising oils, resins and asphaltenes into at least three fractions. The process material is mixed in a mixing zone with a solvent selected from the group consisting of parafinnic hydrocarbons having between about 3 and about 8 carbon atoms. The process material-solvent mixture is introduced into a first separation zone to form an asphaltene-rich first heavy fraction and a resin-rich intermediate fraction, separated by a first liquid-liquid interface, and to form a first light fraction, rich in solvent and oils, separated from the intermediate fraction by a second liquid-liquid interface.

The first heavy fraction and the intermediate fraction are withdrawn from the first separation zone. The first light fraction is introduced into a second separation zone to separate a second heavy fraction, rich in oils, and a second light fraction, rich in solvent.

BRIEF DESCRIPTION OF THE DRAWING

The FIGURE shows the flow of materials in the method of the present invention.

DETAILED DESCRIPTION OF THE PREFERRED EMBODIMENT

The present invention relates to separation of a heavy hydrocarbon process material comprising asphaltenes, resins and oils. Heavy hydrocarbon process materials suitable for use in the method of the present invention include asphalt-type bituminous materials, such as pyrogenous and naturally occurring asphalts, fractions or components of these asphalts, or the products of treating such asphalts, or their components, with air or other oxygen-containing gases.

When a process material of the type described is thoroughly mixed at room temperature with a paraffinic hydrocarbon containing between about 3 and about 8 carbon atoms, the undissolved portion settling out as solids is broadly classified as "asphaltenes", and the soluble portion as "petrolenes" or as a mixture of resins and oils. "Resins" comprise the heavier portion of these soluble components, while "oils" comprise the lighter portion.

Each of the fractions or categories into which process material may be separated is useful for purposes for which the parent material may not be suitable. For example, when the process material is steam or vacuum-reduced asphalt, the oils are useful as lubricants, the resins are useful in coating compositions and as extenders in plastics manufacture, and the asphaltenes are useful in rubber extenders and in coating compositions. The separation of these fractions, in accordance with the method of the present invention, will now be described.

With reference to the FIGURE, feed liquid, comprising process material, is introduced via a conduit 10 into a mixing zone 12. A light organic solvent selected from the group consisting of paraffinic hydrocarbons having between about 3 and about 8 carbon atoms, and preferably comprising pentane, is mixed with the process material in the mixing zone 12 to produce a liquid solvent-process material mixture. The solvent required for the mixing step is provided via a recycle conduit 14 and by a make-up conduit 16. The solvent is mixed with process material in a solvent: process material volume ratio of at least about 3:1, measured at 60° F.

The solvent-process material mixture produced in the mixing zone 12 is transferred via conduit 18 to a first separation zone 20, which preferably comprises a closed vessel. The first separation zone 20 is maintained under temperature and pressure conditions sufficient to permit three separate liquid fractions, of different densities, to form in the first separation zone 20, and to permit a liquid-liquid interface to form between each adjacent fraction.

In order to permit the separation of three fractions in the solvent separation zone 20, the first separation zone 20 is preferably maintained at a temperature within about 30° F. of the critical temperature of the solvent, and at a pressure at or above the critical pressure of the solvent. In the most preferred embodiment of the present invention, the first separation zone 20 is maintained at a pressure within about 300 p.s.i. above the critical pressure of the solvent.

Under the above-described conditions in the first separation zone 20, the solvent-process material mixture separates into an asphaltene-rich first heavy fraction 22 which collects in the lower portion of the first separation zone 20, and a resin-rich intermediate fraction 24, which collects immediately above the first heavy fraction 22. The fractions 22 and 24 contact at a first liquid-liquid interface 26. Collecting immediately above the intermediate fraction 24 is a first light fraction 28, which is rich in solvent and oils. The fractions 28 and 24 contact at a second liquid-liquid interface 30.

The first heavy fraction 22 is withdrawn from the lower portion of the first separation zone 20 via a conduit 32. Flow of liquid in the conduit 32 is regulated by a valve 34, which preferably comprises a level control valve responsive to the level of the first heavy fraction 22 in the first separation zone 20. Thus, as the level of the first heavy fraction 22 rises, the valve 34 opens; as the level of the first heavy fraction 22 lowers, the valve closes. Once it is withdrawn from the first separation zone 20, the first heavy fraction is stripped of its residual solvent in a solvent recovery zone (not shown), such as a stripper.

The intermediate fraction 24 is withdrawn from the medial portion of the first separation zone 20 via a conduit 36. Flow of liquid in the conduit 36 is controlled by a valve 38, which preferably comprises a level control valve responsive to the upper level of the intermediate fraction 24 in the first separation zone 20. Thus, as the upper level of the intermediate fraction 24 rises, the valve 38 opens; as the upper level of the intermediate fraction 24 lowers, the valve 38 closes. Once it is withdrawn from the first separation zone 20, the intermediate fraction is stripped of its residual solvent in a solvent recovery zone (not shown), such as a stripper.

The first light fraction 28 is withdrawn from the first separation zone 20 via a conduit 40, and is transferred to a second separation zone 42. In the second separation zone 42, the first light fraction is separated into a second heavy fraction, rich in oils, and a second light fraction 46, rich in solvent.

Preferably, prior to its introduction into the second separation zone 42, the first light fraction flows through a heater 48, which raises the temperature of the first light fraction to a temperature above that of the first separation zone 20, and above the critical temperature of the solvent. Liquid leaving the heater 48 is transferred to the second separation zone 42, which likewise is maintained at a temperature above that of the first separation zone 16 and above the critical temperature of the solvent, and at a pressure approximately equal to that of the first separation zone 20.

Under the supercritical or near-supercritical conditions in the second separation zone 20, the second heavy fraction 44 separates from the second light fraction 46. The second heavy fraction 44 is withdrawn from the lower portion of the second separation zone 42 via a conduit 50. Liquid flow in the conduit 50 is regulated by a valve 52, which preferably comprises a level control valve responsive to the level of the second heavy fraction 44. Thus, as the level of the second heavy fraction 44 rises, the valve 52 opens; as the level of the second heavy fraction 44 lowers, the valve 52 opens. After it is withdrawn from the second separation zone 42, the second heavy fraction is stripped of its residual solvent in a solvent recovery zone (not shown), such as a stripper.

The second light fraction 46, which consists essentially of solvent, is withdrawn from the upper portion of the second separation zone 42 via recycle conduit 14. Preferably, solvent flowing in the recycle conduit 14 passes through a heat exchanger 54, and surrenders at least a portion of its heat to the first light fraction flowing in conduit 40.

The second light fraction is recycled, via recycle conduit 14, to the mixing zone 12, where it is mixed with process material as required to carry out another cycle of the present invention. In the event that additional solvent is required to carry out the mixing step, this additional solvent is provided via make-up conduit 16. Preferably, the make-up conduit receives solvent recovered from the separated fractions in the solvent recovery zone.

In the preferred embodiment of the present invention, the separation step carried out in the second separation zone 20 is preferably performed under conditions of supercritical or near-supercritical temperature and pressure. However, it should be understood that the separation of the second heavy and light fractions may be carried out by other separative techniques, such as vaporization.

From the foregoing, it will be appreciated that, by maintaining the first separation zone 20 under conditions sufficient to separate three, rather than two fractions, the process of the present invention offers an economical and advantageous separation of process material. Specifically, it will be noted that the process requires fewer heat exchangers and separation vessels than would be required if only two fractions were separated in each separation zone. The process thus offers significant savings in the cost of equipment necessary to carry out separation of a heavy hydrocarbon process material into at least three fractions.

Changes may be made in the construction, operation and arrangement of the various parts, elements, steps and procedures described herein without departing from the spirit and scope of the invention as defined in the following claims.

What is claimed is:

1. A method of separating a process material comprising oils, resins and asphaltenes into at least three fractions, comprising:

mixing the process material in a mixing zone with a solvent selected from the group consisting of paraffinic hydrocarbons having between about 3 and about 8 carbon atoms, in a solvent:process material ratio of at at least about 3:1;

introducing the process material-solvent mixture into a first separation zone maintained at a pressure at or above the critical pressure of the solvent, and at a temperature within about 30° F. of the critical temperature of the solvent, to form an asphaltene-rich first heavy fraction and a resin-rich intermediate fraction, separated by a first liquid-liquid interface, and to form a first light fraction rich in solvent and oils, separated from the intermediate fraction by a second liquid-liquid interface;

withdrawing the first heavy fraction from the first separation zone;

withdrawing the intermediate fraction from the first separation zone; and introducing the first light fraction into a second separation zone to separate a second heavy fraction, rich in oils, and a second light fraction, rich in solvent.

2. The method of claim 1 in which the second light fraction is separated from the second heavy fraction by vaporization.

3. The method of claim 1 in which the second separation zone is maintained at a temperature higher than that of the first separation zone, said temperature above the critical temperature of the solvent.

4. The method of claim 1, further comprising:

withdrawing the second light fraction from the second separation zone; and recycling solvent from the second light fraction to the mixing zone.

* * * * *